United States Patent [19]

Neisius

[11] 4,368,891

[45] Jan. 18, 1983

[54] GOAL FRAME

[75] Inventor: Vinzenz Neisius, Ochtendung, Fed. Rep. of Germany

[73] Assignee: AluTeam Sport and Freizeit GmbH, Koblenz, Fed. Rep. of Germany

[21] Appl. No.: 339,375

[22] Filed: Jan. 15, 1982

[30] Foreign Application Priority Data

Jan. 17, 1981 [DE] Fed. Rep. of Germany ..... 3101325

[51] Int. Cl.[3] ..... A63B 63/02

[52] U.S. Cl. ..... 273/400; 273/1.5 R; 273/55 D; 273/73 D; 273/127 B; 248/524; 52/298; 403/295

[58] Field of Search ..... 273/398-402, 273/411, 127 R, 127 B, 1.5 R, 55 D, 73 D; 248/314, 523, 524, 519, 537, 511; 403/293, 295, 286; 52/298, 297, 704, 708, 710

[56] References Cited

U.S. PATENT DOCUMENTS

| | | | |
|---|---|---|---|
| 841,489 | 1/1907 | Drane | 403/286 |
| 1,606,022 | 11/1926 | Gallaudet | 273/73 D X |
| 3,462,126 | 8/1969 | Demanega | 52/298 X |
| 3,859,767 | 1/1975 | Aspenwall | 403/295 X |
| 3,879,036 | 4/1975 | Portz et al. | 273/73 D X |
| 3,898,728 | 8/1975 | Rousseau | 403/295 X |
| 3,966,207 | 6/1976 | Pass | 273/73 D |
| 3,967,910 | 7/1976 | Tollefsrod | 403/295 X |
| 4,239,235 | 12/1980 | Torres | 273/411 X |

FOREIGN PATENT DOCUMENTS

| | | | |
|---|---|---|---|
| 118901 | 4/1930 | Austria | 52/298 |
| 947298 | 8/1956 | Fed. Rep. of Germany | 52/298 |
| 2366035 | 10/1977 | Fed. Rep. of Germany | 273/55 D |
| 985871 | 3/1951 | France | 403/295 |
| 28838 | of 1902 | United Kingdom | 273/73 D |

OTHER PUBLICATIONS

Brine Soccer Catalog, 1978, p. 13, spg 1.

*Primary Examiner*—Paul E. Shapiro
*Attorney, Agent, or Firm*—Burgess, Ryan and Wayne

[57] ABSTRACT

A goal frame for soccer or similar games comprising hollow bar and post sections, mitered at the corners and rigidly joined to each other by internally located corner pieces. Joined to each corner piece is a supporting tube which projects horizontally from the bar and post toward the back of the goal. The supporting tube is braced against the bar and post sections by braces. The backside of the goal frame has a continuous slot which retains a profiled strip with hooks and eyes for supporting the net. The post sections are supported in ground sockets having annular constrictions.

12 Claims, 13 Drawing Figures

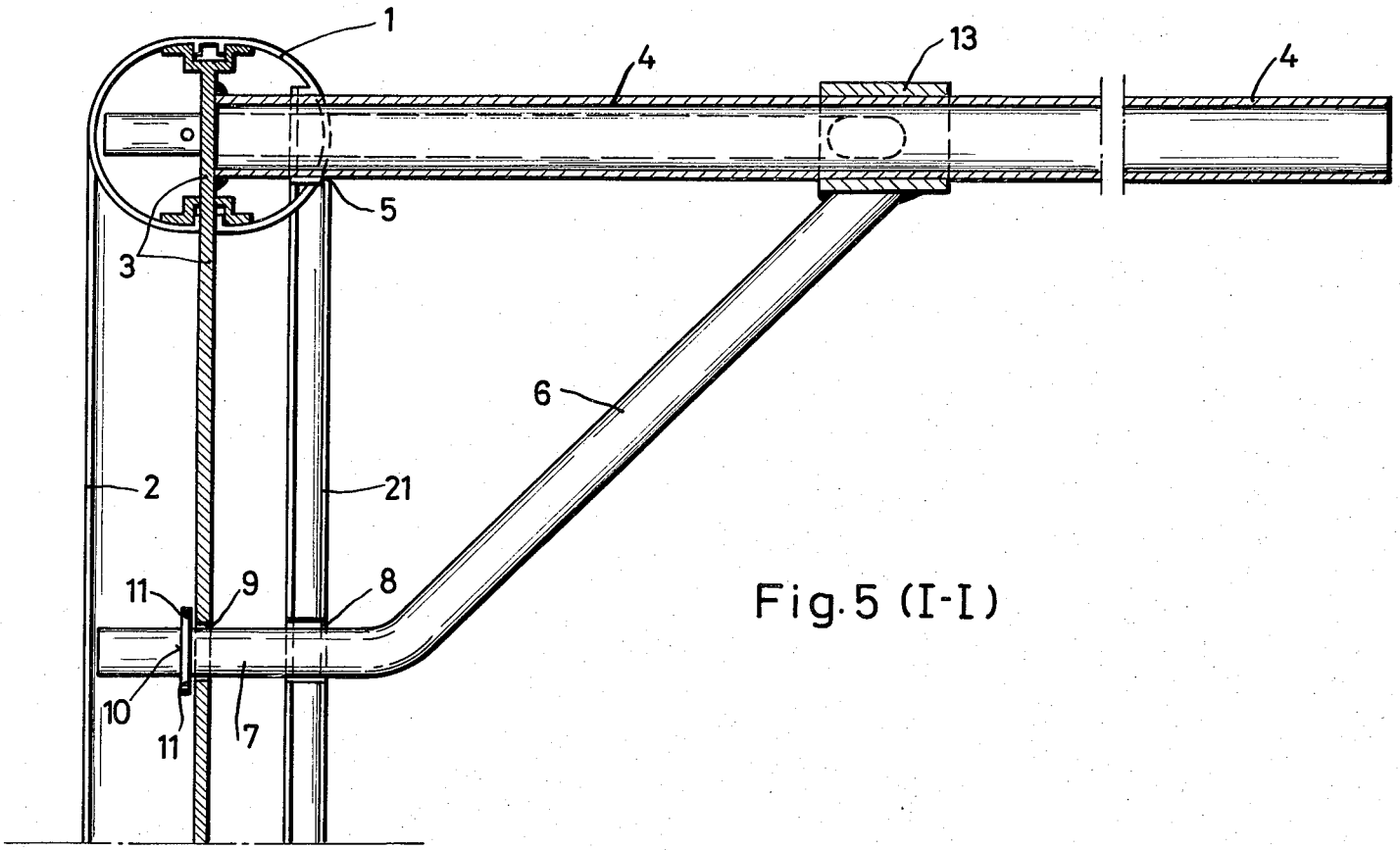
Fig.5 (I-I)

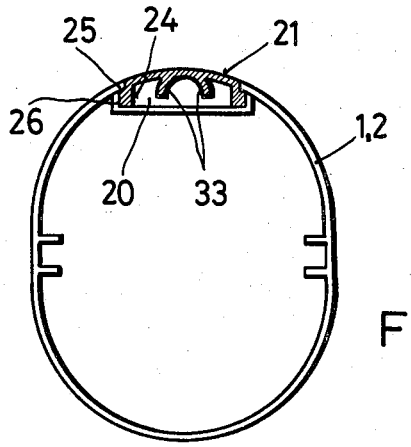
Fig. 6 (II-II)
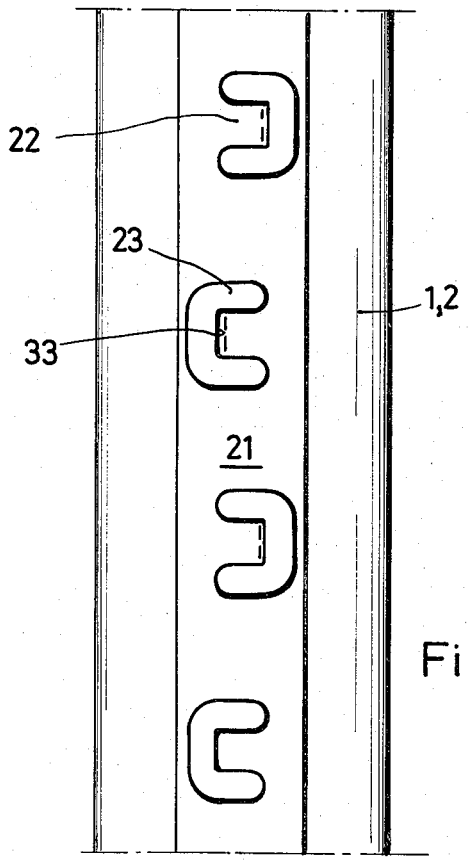
Fig. 7

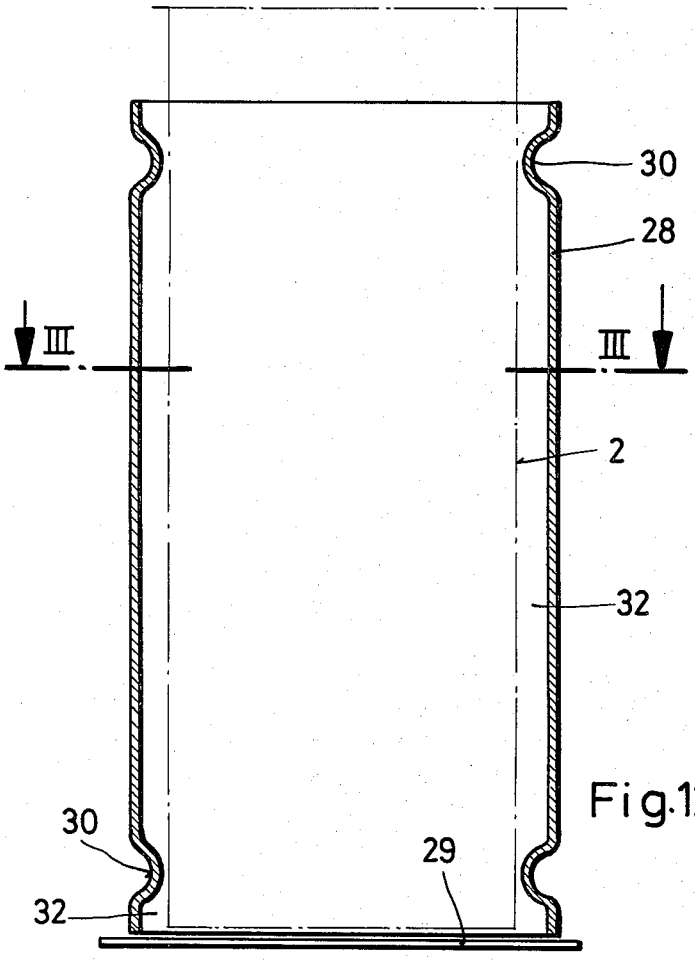
Fig.12
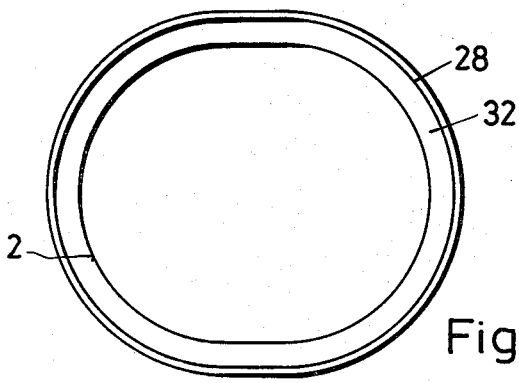
Fig.13 (III-III)

GOAL FRAME

BACKGROUND OF THE INVENTION

The invention relates to a goal frame for soccer or other games which require a goal mounted at ground level assembled of light metal sections. The bar profile and post profiles are formed of mitered hollow sections firmly interconnected by corner pieces which are disposed and retained, in the area of the miters, within the hollow sections. The corner pieces are generally formed from double T-sections, and have fastened, in the corner area of the assembled sections, holding devices for the support of the net. The goal frames are generally further provided, in the longitudinal direction of the section walls pointing towards the backside of the goal, a slot in which are disposed mutually spaced hooks to fasten the net, the ends of the post sections generally being insertable into ground sockets of the same material.

Goal frames of the kind described above are known. The corner angles are connected to the posts and to the bar by several cap screws after insertion in the hollow sections. To accommodate the cap screws, the bar and post sections have holes and corner angle tapped holes. However, assembling the post and bar takes a great deal of time and effort because the tapped holes do not always align when the section corners have been moved together. In addition, the screws are easily lost. Moreover, the stability of the corner connection made in the known manner is not high.

In the known designs, a net yoke with a brace is used as a holding device for the net. The assembly of the net holding device is cumbersome because the components must be fastened in a guide rail on the main sections by means of screws and U-washers.

The guide rail in the known goal frames is a C-slot which extends through the bar and post sections and serves to seat slot nuts in which individual hooks are screwed to hold the net. Apart from the fact that the slot weakens the goal frame sections because it must be very deep, it is very time-consuming and complicated to fasten the various net hooks. About 70 to 80 hooks and slot nuts must be assembled and distributed evenly over the entire perimeter of the goal frame. Furthermore, the hooks are usually spaced no closer than about 300 mm apart, resulting in the net sagging in many places.

Then, after the hook screws are tightened, the hook openings are oriented in different directions, which make hanging the net difficult.

Another disadvantage is that the net hooks so fastened project beyond the goal frame contour. This may readily result in injuries to the players.

To erect the goals, the post ends are inserted into sockets anchored in concrete foundations so that the goal post ends can be removed again from the ground sockets, particularly in winter, and disassembled. In practice, grains of sand and small stones, etc. tend to get between the walls of the inserted post ends and the inside walls of the sockets preventing removal of the posts. The post ends are very tightly seated in the sockets in order to keep the frame in an upright position. The small clearance has the further disadvantage that when erecting or removing the goal, the two post ends must always be moved evenly and vertically to prevent their jamming in the sockets. Therefore, once a goal has been erected, it is hardly possible to take it out of its sockets again.

It is an object of the invention to provide a goal frame which is easy to assemble and disassemble, has great stability and is designed to reduce accident hazards.

BRIEF DESCRIPTION OF THE INVENTION

According to the invention, there is provided a supporting tube joined to the mitered and welded-together double T-sections of the corner angles perpendicular to the web plane, at their respective miter center, a supporting tube to support the net, or a short pipe nipple, extending through an opening in the bar and post sections, after they were placed on the corner angle, so as to project in the direction of the goal backside, its free end being supported against the bar and post sections by means of braces in the form of tubular hollow sections disposed in pairs, said braces being joined at one end to the supporting tube or pipe nipple by joining preferably, a screw bolt disposed in transverse direction to the latter, while they have at their other end, ends which are bent at an angle to the bar and post sections and are inserted in matching openings in the bar and post sections and in the corner angle, being retained therein by exerting tension forces in the direction of the bar and post section miters.

Due to the inventive design of the corner connection of the goal frame with supporting tube or pipe nipple and braces, its assembly and disassembly are simplified and accelerated. Only a single fastening means is required to secure the corner connection, namely the fastening means to join the brace ends to the supporting tube or pipe nipple. The corner connections can be assembled effortlessly. In addition, the supporting tube advantageously offers a support for the net.

The corner connection, according to the invention, provides a supporting tube or pipe nipple which is securely supported in all directions with its angularity to the goal frame as well as the stability of the corner connection being assured. Additionally, the connection effects especially good stiffening of the entire goal frame. Moreover, the lever effect of the stiffening braces assures that the bar and post sections are held together at the miter edges with great force, leaving no gaping joints.

It is also advantageous that the supporting tube according to the invention is suited for the attachment of another long, downwardly bent holding yoke supported by the ground so that a goal frame for soccer league games can be made simply and effortlessly.

In a further advantageous embodiment of the invention, the walls of the bar and post sections pointing towards the goal backside are provided over their entire length with a slot which is covered by a profiled strip arched convexly on the outside, in which hooks and eyes to hold the edge of the net are stamped out so that they are integrated with the outside wall of the profiled strip.

The profiled strip with the integrated hooks, designed according to the invention, is inserted by the factory in the continuous slot in the bar and post sections and locked, thus requiring no further assembly work when erecting the goal.

Threading a muliplicity of slot nuts with net hooks into the slot of the goal frame, which required much time and effort, is thus eliminated. Beyond this, the elimination of the slot nuts brings with it the advantage of a simplification of the section profile of the seating slot integrated in the wall of the goal frame sections (elimination of the C-profiling of the slot due to elimination of its C-profile and shallower slot depth), contributing to greater stability of the sections.

Since the hooks according to the invention, are integrated into the contour of the goal frame, the advantage is obtained, among others, that the hazard of injuries is reduced because no hooks project from the slot in the goal frame.

BRIEF DESCRIPTION OF THE DRAWINGS

The invention is illustrated schematically in the drawings by way of two embodiment examples.

FIG. 5 shows a vertical section of the corner of the goal frame with corner angle and the supporting tube with brace according to line I—I in FIG. 4, FIG. 6 shows a vertical section of the goal frame profile and of the profiled strip inserted in the slot, with hooks bent inwardly at the ends, without retaining projections according to line II—II in FIG. 4, FIG. 7 shows a partial view of the rear of the goal frame with a view of the profiled strip inserted in the slot, with hooks bent inwardly at the ends, without retaining projection, in larger scale, FIG. 12 shows a vertical section of a ground socket with post end shown in --- lines inserted, and FIG. 13 shows a horizontal section of the ground socket with post end inserted according to line III—III in FIG. 12.

DETAILED DESCRIPTION OF THE INVENTION

Figure 2:
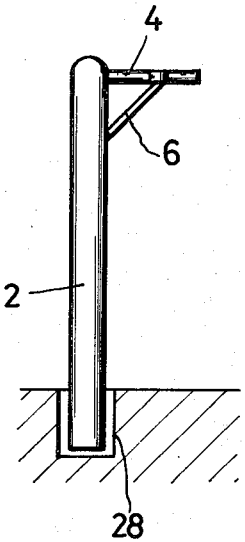
FIG. 2 shows the side view of the goal frame designed according to FIG. 1.
Figure 1:
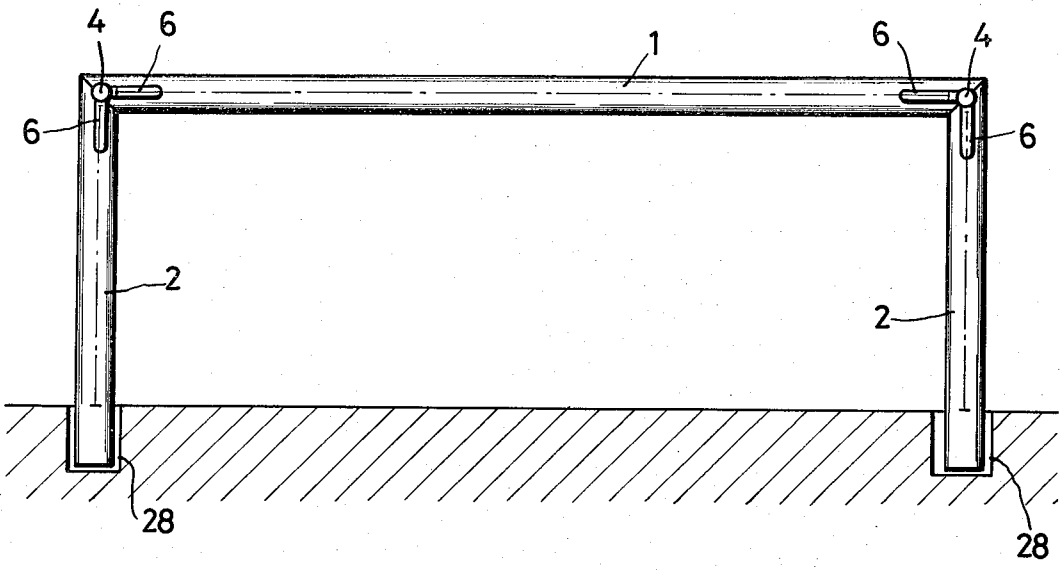
FIG. 1 shows the rear view of a goal frame designed in accordance with the invention and inserted in ground sockets.
Figure 3:
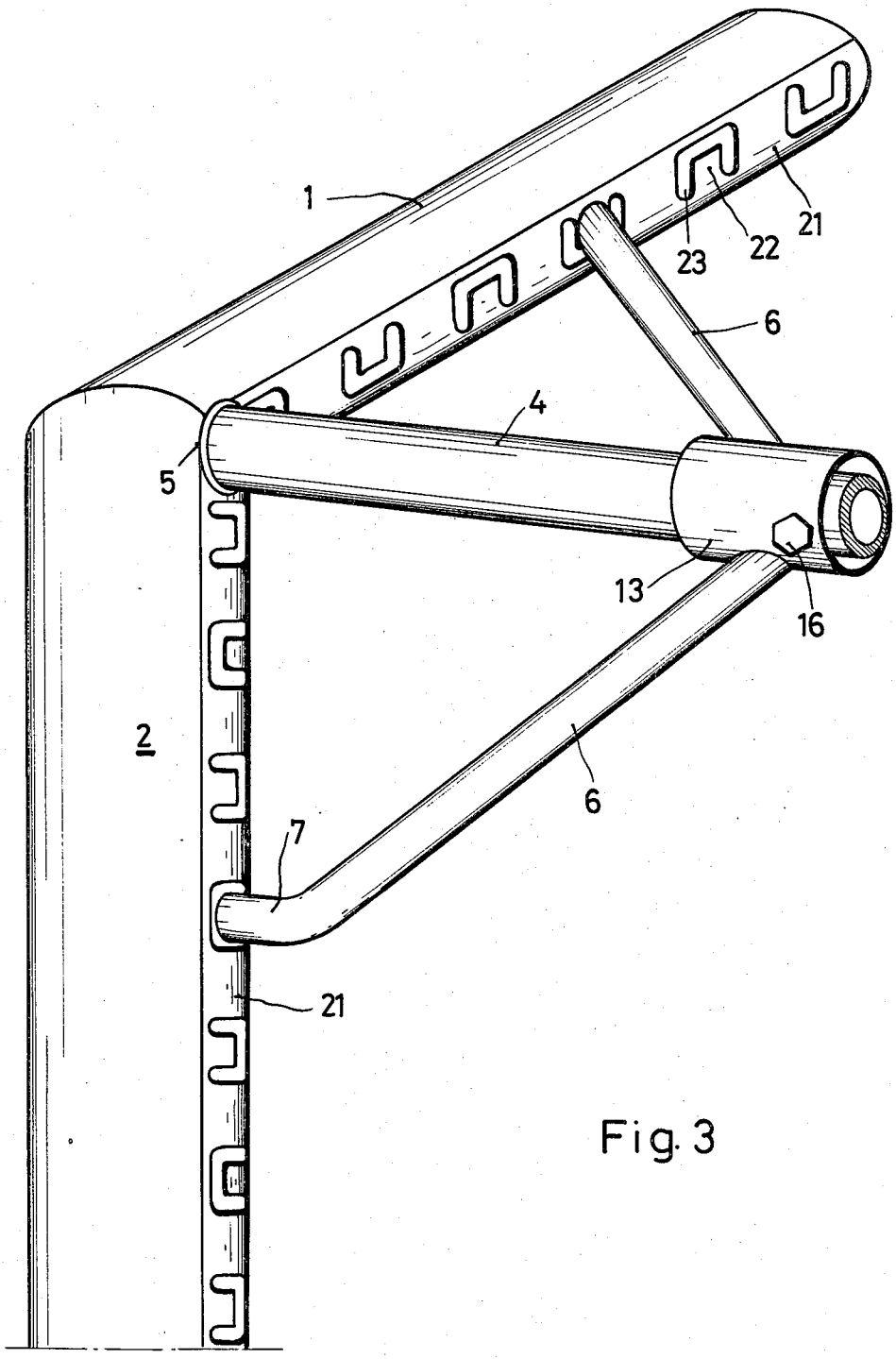
FIG. 3 shows the three-dimensional part view of the goal frame from the rear.
Figure 4:
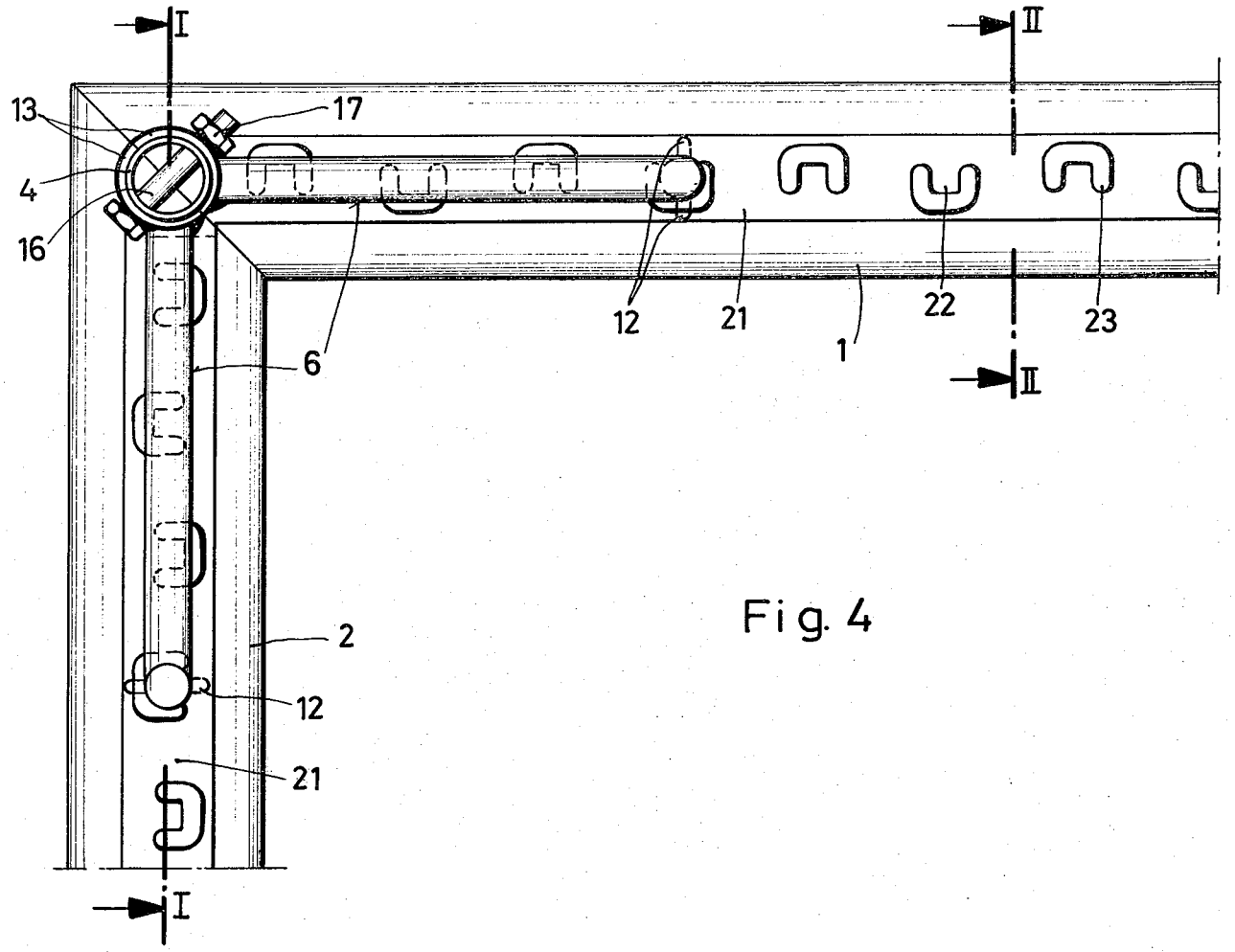
FIG. 4 shows the rear view of a corner of the goal frame, with a view of the supporting tube with the braces, in larger scale.

In a further advantageous embodiment of the invention, the braces are provided at their one end with holding cups which, opposite each other, are in contact with the supporting tube or pipe nipple, and mutually corresponding holes are disposed in the walls of the holding cups and supporting tube or pipe nipple through which a screw bolt is pushed.

The supporting tube or pipe nipple is supported and retained securely in all directions, the fastening requiring only a single screw bolt.

It is advantageous, furthermore, that, at their ends bent at right angles to the bar or post sections, the braces each have locking bolts disposed transverse to the direction of the braces, with ends projecting beyond the outer tubular walls of the braces, which ends are retained against the web walls after insertion through appropriately shaped recesses in the respective corner angle leg and turned by 90° into their final position.

According to another advantageous embodiment of the invention, the braces may have, in their outer wall areas pointing to the corners of the goal frame in the area of their point of penetration of the corner angle leg, a transversely extending notch each which hooks into the wall of the associated corner angle leg after the insertion and assembly of the brace.

These two alternative measures prevent, with certainty, lift out of the braces.

According to another advantageous embodiment of the invention, the braces supporting the short pipe nipple are shaped so as to run parallel to the bar or post sections. This alternative makes possible the use of the corner connection according to the invention in goal designs without provision for the support of the net.

Advantageously, as viewed in cross-section, the profiled strip to support the net has, on its long edges, short legs which are bent outwardly and engage slot shaped recesses formed by strips at the slot edges, after insertion of the profiled strip. This provides secure hold of the profiled strip in its seating slot and its integration in the outer contour of the main section without requiring expensive profiling of the seating slot. The bent legs of the profiled strip as well as the slot shaped recesses in the slot need only be of small dimensions so that weakening of the section is avoided.

It is preferred that the hooks are stamped out of the profiled strip in transverse direction of the latter, alternating in their orientation relative to each other, and that, furthermore, all hooks eyes are disposed on the center axis of the profiled strip.

Due to the fact that the hooks point alternately in the opposite direction, it becomes more difficult for the net retaining rope to unhook itself.

Due to the fact that the profiled strip including the hook and eye components is pre-arched in convex shape and adapted to the surface contour of the bar and post sections, the hook parts are readily accessible, rendering the suspension of the net much easier and avoiding the danger of accidents. It is also advantageous that the hooks of the design according to the invention are always oriented in one direction, namely in the transverse direction of the profiled strip so that the openings are readily accessible when hooking up the net.

The hook ends are advantageously bent slightly towards the interior of the profiled strip. This helps prevent unhooking of the net holding rope and, at the same time reduces the danger of accidents.

According to another embodiment of the invention, the hook ends may be provided with two retaining projections each, opposite to each other and oriented in the longitudinal direction of the profiled strip. This, too, helps prevent the net holding rope from unhooking itself.

Due to the fact that 11 hook eyes are arranged in the direction of the longitudinal center line of the strip, the net suspension rope always runs in one direction which also facilitates hooking it up.

A preferred embodiment of the profiled strip according to the invention provides for spacing of the hooks at roughly 60 mm. intervals. The close hooking assures tight seating of the net everywhere on the goal frame without sagging.

According to another preferred embodiment of the invention, the bottom of the ground sockets which receive the ends of the post sections are each closed by a bottom plate and are provided with two mutually parallel, annular constrictions, one just under the opening and the other above the bottom plate, said constrictions making close contact with the outer wall of the post section after its insertion in the ground socket so that annular spaces are formed between the inner wall of the ground socket and the outer wall of the post sections.

This embodiment increases the inside diameter of the ground socket in such a manner that an annular space interrupted only by the constrictions is formed between the inner wall of the ground socket and the outer wall of the inserted post end of the frame section. This has the advantage that lifting the post ends is not hindered by dirt particles, grains of sand, or the like, because there is always adequate clearance. However, the linear support of the post ends by means of the constrictions provides for good seating of the inserted goal frame.

The spacing of the constrictions provides good guidance for inserting the post ends and assures that the goal can be taken out more easily when disassembling it. Due to the length of the post end inserted in the socket, relative to the lower construction, the post end has more freedom of motion when being pulled out so that it does not necessarily have to be evenly and vertically removed as required with known socket designs.

The embodiment example of the invention shown schematically in the drawings by way of a soccer goal consists of a goal frame assembled of a bar section 1 and post sections 2. Used as sections are hollow light-metal sections of identical profile, mitered at the corners and interconnected by means of corner angles 3 (FIG. 5), disposed and retained in the hollow sections, in the form of mitered double T-sections welded together. However, hollow box-type sections may also be employed as corner angles.

Welded to the miter center, in the web area of the corner angles 3 formed of double T-sections, at right angles to said web area, is a supporting tube 4. In an embodiment not shown in the drawings, where the corner angles are formed of box-type hollow sections, the end of the supporting tube 4 penetrates both section walls and is welded to them. This provides particularly great stability for the supporting tube/corner angle connection.

Disposed in each mitered bar and post section 1, 2, in the walls pointing to the backside of the goal and likewise in the miter center area, are mutually opposite recesses which, after the sections are joined, leave free an opening 5 of the diameter of the supporting tube 4. After insertion of the corner angle 3 including the welded-on supporting tube 4 into the hollow portion of the bar and post sections 1, 2 and after their assembly, the supporting tube 4 projects out of the opening 5 horizontally towards the backside of the goal.

The supporting tubes 4 are supported against the bar section 1 and post sections 2, respectively, by means of braces 6 in the form of tubular hollow sections arranged in pairs. The one end 7 of the braces 6 are bent at an angle towards the goal frame and pass through matching openings 8, 9 provided in the walls of the bar and post sections 1, 2 as well as the corner angles 3 and fastened in the corner angle 3 by means of a lock bolt 10. The lock bolt 10, pentrates the brace 6 transversely, has short ends 11 which project beyond the outer wall of the brace 6 and are passed through corresponding, matching recesses 12 provided on the openings 8, 9 in the bar and post sections 1, 2 and in the corner angle 3 during assembly. After turning the braces 6 into their final position, the lock bolts 10 are retained by the wall of the corner angle 3.

In place of a lock bolt 10, there may also be provided in the area of pentration of the corner angle leg, on the respective outer tube wall of brace 6 pointing to the miter, a notch, not shown in the drawings, which runs transverse to the brace 6 and hooks into the corner angle after the assembly of brace 6.

The other ends of the braces 6 are provided with holding cups 13 so arranged and shaped that, after the assembly of the braces 6, they are opposite each other and grip the end of supporting tube 4 in close contact. Provided in the walls of the holding cups 13 and the supporting tube 4, are matching holes 14 and 15, respectively, through which a screw bolt 16 can be passed transverse to the supporting tube 4 so that everything is joined into a sturdy connection by the counternut 17. In this way, the supporting tubes 4 serves to support the net on the one hand and at the same time, they also serve to secure the corner connection of the goal frame according to the invention.

Figure 10:
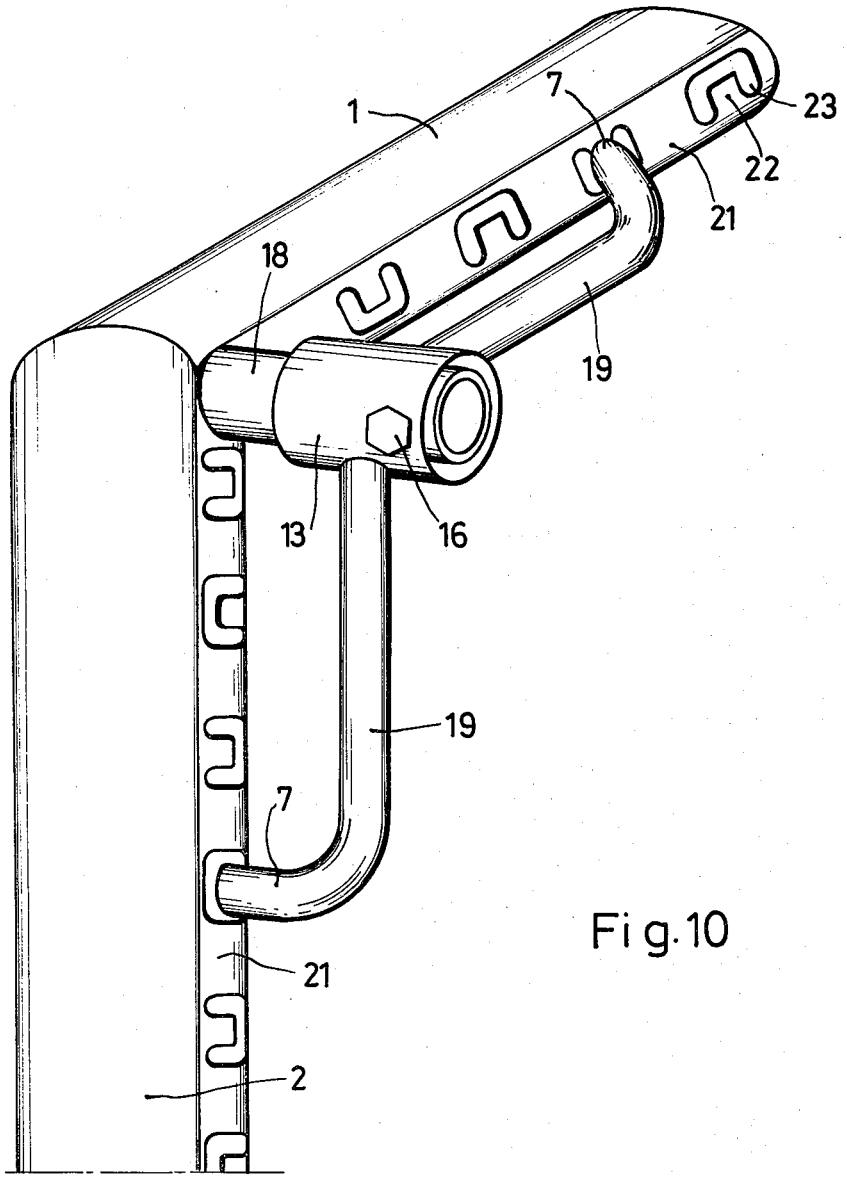
FIG. 10 shows the three-dimensional part view of another embodiment of the goal frame according to the invention, with short pipe nipple.
Figure 11:
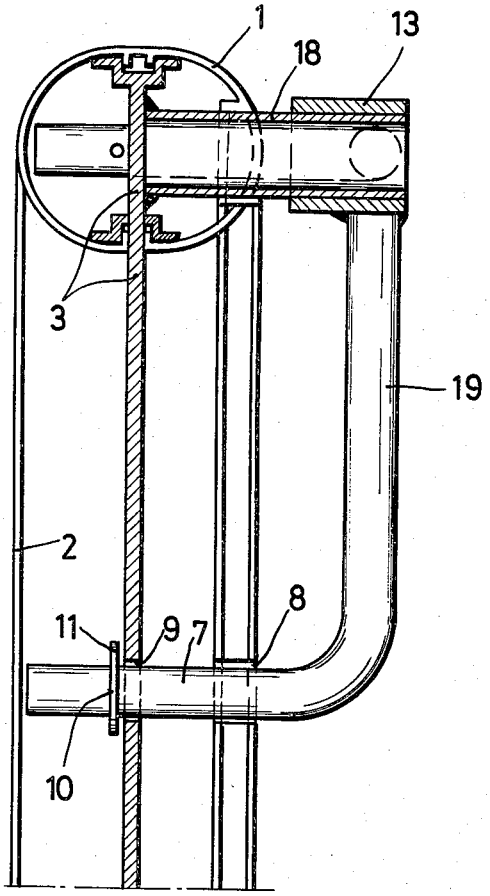
FIG. 11 shows a vertical section of the corner of the goal frame with corner angle and pipe nipple with brace according to the embodiment in FIG. 10.

If supporting tube 4 is not required to hold the net, a short pipe nipple 18 may be provided instead, according to another embodiment of the invention (see FIG. 10), where the braces 19 are shaped so as to extend not obliquely, but parallel to the support and bar sections 2 and 1, respectively. The fastening mode is the same as for the braces 6.

The walls of the bar and post sections 1, 2 pointing towards the backside of the goal frame contain a slot 20 which extends over their entire length and is covered by an outwardly convexly arched, profiled strip 21 into which are worked the hooks 22 and eyes 23 which hold the edge of the net. The hooks and eyes are stamped out of the profiled wall.

As viewed in cross-section, the profiled strip 21 has, on its long edges, short legs 24 bent outwardly at an angle. After the assembly of the profiled strip 21, these legs engage slot shaped recesses 26 formed by strips 25 on the edges of the slot 20.

Figure 8:
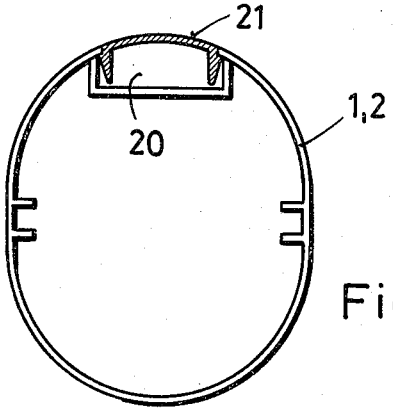
FIG. 8 shows a vertical section of the goal frame profile and of another embodiment of the profiled strip inserted in the slot, with retaining projections disposed on the hooks.
Figure 9:
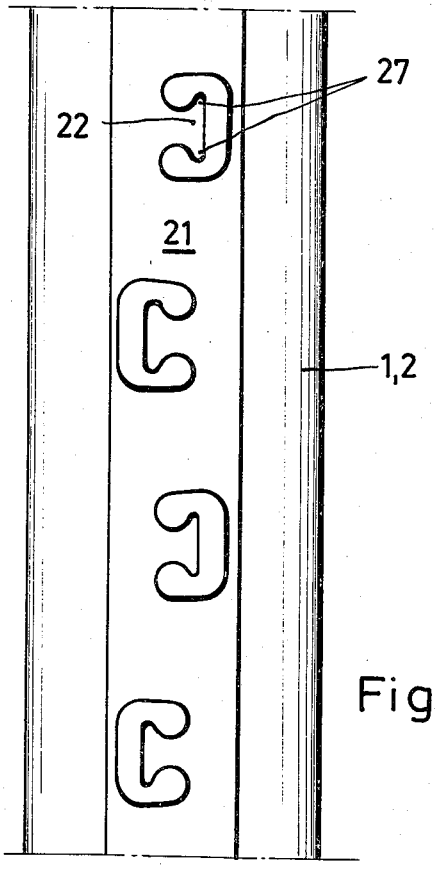
FIG. 9 shows a partial view of the rear of the goal frame with the profiled strip according to the embodiment in FIG. 8.

The hooks 22 of the profiled strip 21 are arranged so as to point alternately in mutually opposite directions in the transverse direction of the profiled strip 21. The ends of the hooks 22 may be provided, each with retaining projections 27 (FIG. 8), which point in the longitudinal direction of the profiled strip 21 and are oriented in mutually opposite direction. The hooks may have no retaining projections and their ends 33 can be slightly bent towards the interior of the profile strip 21 (FIG. 7). The hooks 22 and eyes 23 are provided over the entire length of the profiled strip 21 at an insertion pattern of about 60 mm. In a preferred further development of the invention, the ends of the hooks 22 including the retaining projections 27 may also be bent inwardly.

The whole goal frame is erected by plugging the ends of the two post sections 2 into ground sockets 28 anchored in the ground. Due to the preferred design of the ground sockets, it is possible to remove the goal frame again from the ground sockets 28 by simply lifting its post ends out of the ground sockets 28, even if the latter are contaminated by small stones or grains or sand.

As shown in FIG. 12, each ground socket 28 has a bottom plate 29 and two annular constrictions 30 disposed parallel to each other, one just below the opening 31 and the other above the bottom plate 29. These constrictions make contact with the post section 2, supporting it. In this way, annular spaces of relatively great width are formed between the inner wall of the ground sleeve 28 and the outer wall of the post section 2 so that binding due to sand or small stones cannot happen when removing the post sections.

All single and combination features disclosed in the specification and/or the drawings are considered essential to the invention.

I claim:

1. In a goal frame for games, assembled of light metal sections comprising a bar section and post sections formed of mitered hollow sections firmly interconnected by internally located corner angles which are disposed in the area of the miters, and are formed of double T-sections, there being provided in the corner area of the assembled sections, a holding device for the support of the net and there further being provided, in the longitudinal direction of the section walls pointing towards the backside of the goal, a slot in which are disposed mutually spaced hooks to fasten the net and the ends of the post sections being insertable into ground sockets, the improvement which comprises a supporting tube, welded perpendicular to the web plane of the mitered double T-sections of the corner angles joined to each other, on their respective miter center which passes through an opening left free by the bar and post sections after having been inserted over the corner angle so that said supporting tube projects in the direction of the backside of the goal and its free end is respectively supported by said bar and post sections by braces provided in pairs in the form of tubular hollow sections the one end of said braces being fastened to the supporting tube by means disposed transverse to said supporting tube while the other end is bent at right angles towards the bar and post sections, which ends are inserted in openings in the bar and post sections, which ends are inserted in openings in the bar and post sections and in the corner angle and are retained therein, exerting tension forces in the direction of the miters of the bar and post sections.

2. A goal frame according to claim 1, wherein the walls of the bar and post sections pointing towards the backside of the goal contain a slot extending over the entire length of said sections and are covered by a profiled strip arched convexly on the outside, hooks and eyes being stamped out of said strip to hold the net in such a way as to be integrated in the outer wall of the profiled strip.

3. A goal frame according to claim 1 or 2, wherein the braces are provided at their one end with holding cups which, oppose each other, contact the supporting tube and have matching holes provided in the walls of holding cups and supporting tube through which holes a screw bolt is passed.

4. A goal frame according to claims 1 or 2 wherein the braces at their ends are bent perpendicular to the bar or post section, the braces each having locking means which are disposed transverse to the brace direction and have ends projecting beyond the outer tube walls of the braces and, after having passed through appropriately shaped recesses in the respective corner angle leg and turning by 90°, are held in final position against the web walls.

5. A goal frame according to claim 1 or 2, wherein the braces in the area of their respective point of penetration of the corner angle legs have, in their outer areas pointing to the corners of the goal frame, a transverse notch which hooks into the wall of the associated corner angle leg after the brace has been assembled.

6. A goal frame according to claim 1 or 2 wherein the braces supporting the supporting tube are shaped so as to run parallel to the bar or post sections.

7. A goal frame according to claim 1 or 2, wherein, as viewed in cross-section, the profiled strip to support the net has, at its long edges, short legs bent outwardly at an angle which engage slot shaped recesses formed at the edges of the slots after insertion of the profiled strip.

8. A goal frame according to claim 1 or 2, wherein the hooks are stamped out of the profiled strip in a transverse direction, alternately oriented in opposite direction, and that, further, all hook eyes are disposed on the center axis of the profiled strip.

9. A goal frame according to claim 1 or 2, wherein, at their ends, the hooks are bent slightly towards the interior of the profiled strip.

10. A goal frame according to claim 1 or 2, wherein, at their ends the hooks are each provided with two mutually opposed retaining projections pointing in the longitudinal direction of the profiled strip.

11. A goal frame according to claim 1 or 2, wherein the mutual spacing of the hooks is approximately 60 mm.

12. A goal frame according to claim 1 or 2, wherein the ground sockets which receive the ends of the post sections are closed at the bottom by a bottom plate and have two mutually parallel, annular constrictions, one shortly below the opening and the other above the bottom plate, which constrictions make close contact with the outside wall of the post section after insertion into the ground socket so that annular spaces are formed between the inside wall of the ground sockets and the outside wall of the post section.

* * * * *

UNITED STATES PATENT AND TRADEMARK OFFICE

CERTIFICATE OF CORRECTION

PATENT NO. : 4,368,891

DATED : Jan. 18, 1983

INVENTOR(S) : Vinzenz Neisius

It is certified that error appears in the above-identified patent and that said Letters Patent is hereby corrected as shown below:

Column 2, line 64, "muliplicity" should read --multiplicity--.

Column 5, line 67, "pentrates" should read --penetrates--.

Column 6, line 8, "pentration" should read --penetration--.

Column 6, line 65, "or sand" should read --of sand--.

Column 7, line 34, after "sections" should be a comma (,).

Signed and Sealed this

First Day of May 1984

[SEAL]

*Attest:*

GERALD J. MOSSINGHOFF

*Attesting Officer*

*Commissioner of Patents and Trademarks*